US005873289A

United States Patent [19]

Jarvis

[11] Patent Number: 5,873,289

[45] Date of Patent: Feb. 23, 1999

[54] RELEASABLE LOCKING CONNECTOR FOR TOOL

[76] Inventor: Jack D. Jarvis, 3204 Periwinkle, Memphis, Tenn. 38127

[21] Appl. No.: 773,271

[22] Filed: Dec. 23, 1996

Related U.S. Application Data

[63] Continuation-in-part of Ser. No. 398,691, Mar. 6, 1995, abandoned, and a continuation-in-part of Ser. No. 586,605, Jan. 16, 1996, abandoned.

[51] Int. Cl.[6] ..... B25B 23/16

[52] U.S. Cl. ..... 81/177.85; 81/177.2; 403/325

[58] Field of Search ..... 81/177.2, 177.85; 403/325, 330; 279/82, 86

[56] References Cited

U.S. PATENT DOCUMENTS

| | | | |
|---|---|---|---|
| 4,339,970 | 7/1982 | Enstrom | 81/177.85 X |
| 5,214,986 | 6/1993 | Roberts | 81/177.85 |
| 5,333,523 | 8/1994 | Palm | 81/177.85 |
| 5,644,958 | 7/1997 | Roberts et al. | 81/177.85 |

*Primary Examiner*—James G. Smith
*Attorney, Agent, or Firm*—Paul M. Denk

[57] ABSTRACT

A releasable locking connector for a tool, having an elongated body, at least one detent blade slidably seated within the elongated body, and more particularly a groove formed therein a spring bias collar on the body operably attached to the detent blade, the collar normally biasing the detent blade into a position for protrusion from the groove and to engage and lock in the opening of a socket or other tool.

5 Claims, 2 Drawing Sheets

RELEASABLE LOCKING CONNECTOR FOR TOOL

CROSS-REFERENCE TO RELATED APPLICATION

This application is a continuation-in-part of application having Ser. No. 08/398,691, filed Mar. 6, 1995 abandoned, and a continuation-in-part of application having Ser. No. 08/586,605, filed Jan. 16, 1996 abandoned.

BACKGROUND OF THE INVENTION

This invention relates generally to hand tools and more specifically to a releasable, locking socket connector.

Socket wrenches are known to the art. Generally, a socket wrench set has a number of interchangeable sockets that can be attached to a drive head which is integrally connected to a drive handle. The sockets are cylindrical in shape and have a square opening at one end for the attachment to the socket drive head and a round, internally faceted workpiece engaging orifice at the other end. Typically, the workpiece is a nut or a bolt. The sizes of the workpiece engaging orifices differ among the various interchangeable sockets so that the user can change sockets depending upon the size of the nut or bolt. For example, the socket can range from ¼ inch to one inch or more.

Generally speaking, the drive, as connected to a handle, has a square drive. The square drive engages the square opening in the socket. Further, prior art square drives generally are secured within the socket by a tight friction fit or be a spring-biased detent ball which engages an indentation on the inside of the square opening. Since the square socket is of a predetermined dimension, i.e. quarter inch, half inch, one inch, etc., it can only accommodate one size of socket In my co-pending application Ser. No. 08/398,691, I address this limitation by providing interchangeable sockets and drives that increase the versatility of a set of socket wrenches.

Prior designs, however, do not address another problem encountered by the user. That is, the conventional friction fit socket often does not adequately secure the socket onto the drive. A single detent means, such as a detent ball, may not hold the socket on the drive in some situations. This is particularly important where the drive is part of an extension piece since such extensions are generally less stable than a directly mounted socket. It would be advantageous to have a square drive or a square extension connector that employs a positive securing mechanism to hold the socket on the square drive.

SUMMARY OF THE INVENTION

It is among the several objects of the present invention to provide a mechanism for securing a square drive within the complementary opening of a socket or extension device.

Another object of the present invention is to provide such a mechanism that employs a positive, releasable locking mechanism.

Still another object of the present invention is to provide a positive locking mechanism that can recede into a facet of the square drive.

Yet another object of the present invention is to provide such a positive locking mechanism that can recede into a shallow opening formed in the facet of the square drive so that even a small square drive can accommodate more than one such locking mechanism for added security, and to provide a more firm and tight socket fit.

In accordance with the invention, a releasable locking mechanism for a square drive of a socket wrench or connector is provided. The mechanism includes an elongated body having a square end. The square end has four facets and at least one facet has a groove formed therein. A flat detent blade is seated in the groove so as to be moveable from a first extended position for engaging a complementary indention in a socket to a second retracted position for release. The mechanism includes a spring biased collar at the distal end of the square end that actuates the detent blade. The collar is normally biased so that it retains the blade in the first position to secure the square end in the socket. The collar can be moved against the bias spring and thus retract the blade to allow release from the socket. In the preferred embodiment, there are at least two blades in opposed facets of the square end. The square end can accommodate up to four detent blades for firm socket securement.

BRIEF DESCRIPTION OF THE DRAWINGS

Corresponding reference figures represent corresponding elements throughout the various drawings.

DESCRIPTION OF THE PREFERRED EMBODIMENT

Figures 1, 2, 3:
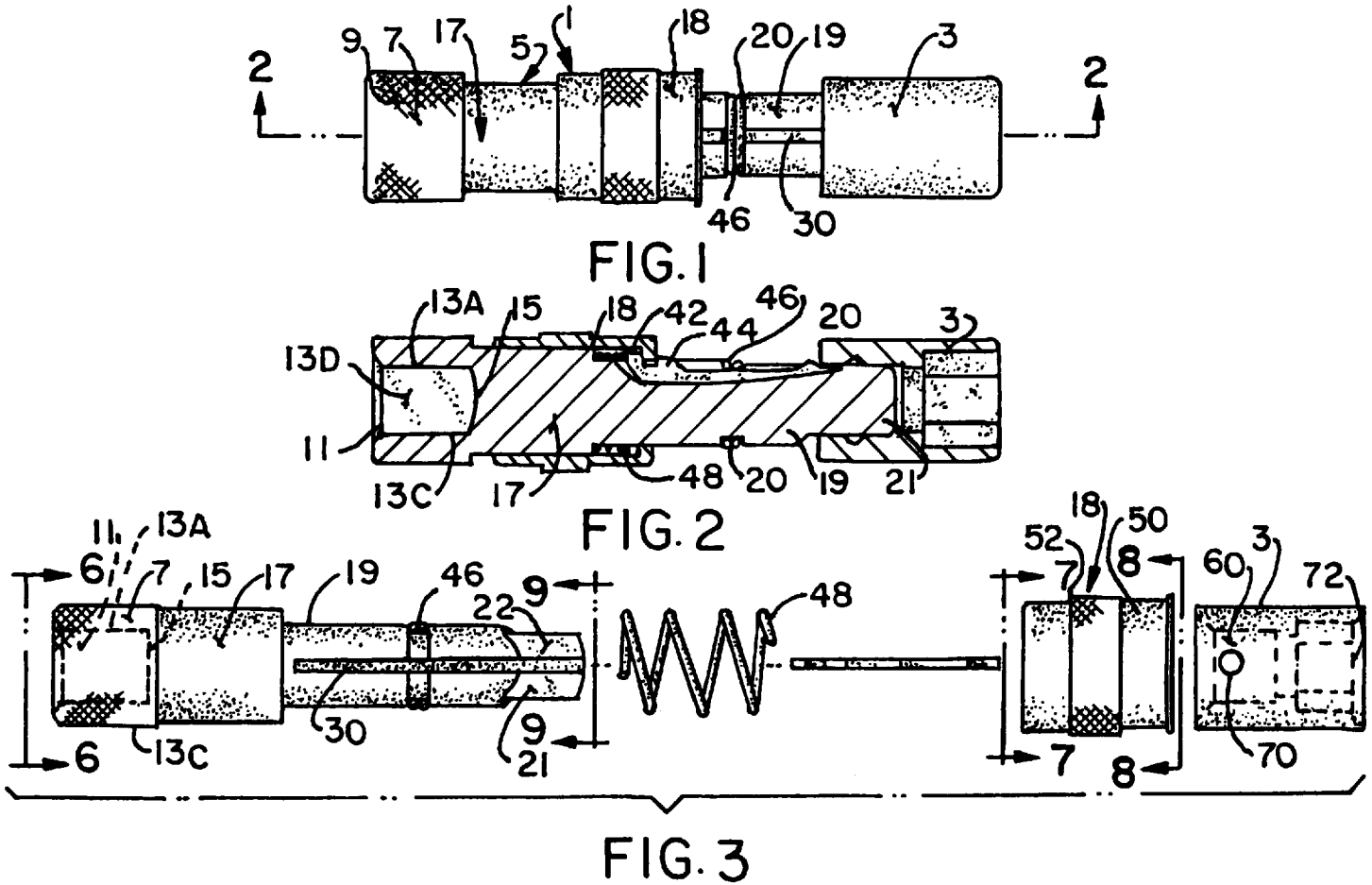
FIG. 1 is a side elevational view of one illustrative embodiment of the connector of the present invention attached to a socket.
FIG. 2 is a cross sectional view thereof taken along line 2—2 of FIG. 1.
FIG. 3 is an exploded view of the connector and socket of FIG. 1.

The releasable, locking connector of the present invention is indicated generally by reference numeral 1. Connector 1 is shown in the drawings as attached to a socket 3, for illustrative purposes. I will be appreciated by those skilled in the art that connector 1 can be used for attaching a socket, another connector, or, any other device having an opening dimension to releasably seat the connector, as will be explained in greater detail below. It will be appreciated that the locking mechanism of the present invention is described in detail as used with an elongated connector. It will be appreciated, however. that the locking mechanism can be used with the square drive of a socket wrench, or any other tool.

Figure 6:
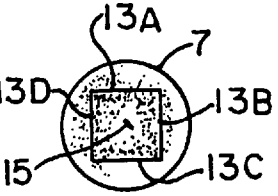
FIG. 6 is an end plan of the opposite end of the connector taken along line 6—6 of FIG. 3.
Figure 5:
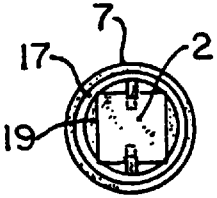
FIG. 5 is an end plan of the square of one illustrative embodiment of connector taken along line 5—5 of FIG. 4.

With reference to the illustrative embodiments of FIGS. 1–3, connector 1 includes an elongated, substantially cylindrical body section 5. Body 5 includes a first or butt-end 7. Butt-end 7, which has a knurled outer surface 9 includes a bore 11. As best seen in FIG. 6, bore 11 includes four opposed flat walls 13A, 13B, 13C and 13D, and a slightly concave forward wall 15. Bore 11 is dimensioned to seat a conventional ratchet square drive (not shown), a connector of the present invention, or similar device.

Body 5 also includes a side section 17 concentric to butt-end 7. Slide section 17 has an external diameter dimensioned to slidingly seat a retention collar 18, as will be described below. Body 5 also includes an elongated barrel section 19 concentric to the slide section. Barrel 19 includes a circumferential groove 20 formed therein generally at the midpoint. Barrel section 19 terminates in a square end 21. The square end has four facets 22. At least one elongated, substantially narrow, relatively shallow groove 23 is formed in the side of barrel 19 and extending shallowly into a facet 22 of tip 21. As can be seen, the illustrative embodiment of FIG. 2 has one groove 23. The illustrative embodiment of FIG. 3 has two grooves 23 positioned at 180° to each other. It will be appreciated by those skilled in the art that the connector of the present invention requires at least one such groove, but, because the grooves are relatively shallow and do not cut completely through barrel 19, the connector can have up to four such grooves positioned at 90° to each other and extending into each of the four facets 22 of tip 21.

Figure 4:
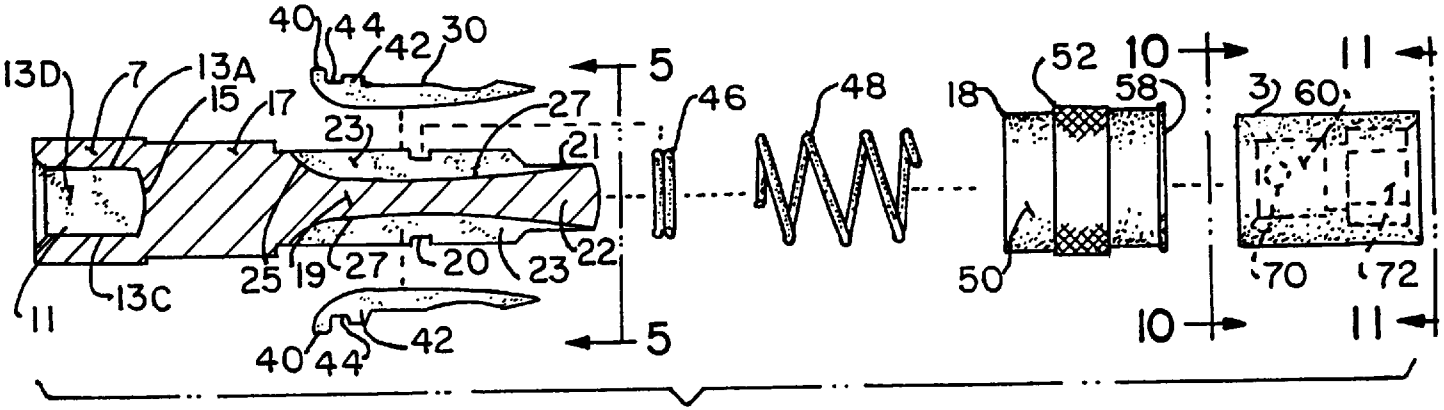
FIG. 4 is an exploded view, partially in cross section, of another illustrative embodiment of the connector of the present invention.

As best seen in FIG. 4, groove 23 includes a rear wall 25 that slopes somewhat abruptly rearwardly and toward the surface of the barrel. Groove 23 also includes a bottom wall 27 that slopes forwardly toward the surface of the fact. The groove 23 is most shallow at the facet and deepens toward the middle of the groove and becomes shallower at rear wall 25 so that the groove has a generally concave profile.

The connector includes a detent blade 30 seated in each groove 23. Each detent blade 30 has a substantially flat body 31 with a convex edge 34 complementary to the bottom wall of groove 23. Blade 390 includes an opposite edge 35 that has detent tip 38 formed thereon. Edge 36 also includes a hook 40 and a spaced apart tab 42 at the opposite end. Hook 409 and tab 42 define space 44 which seats a ring on retention collar 18, as will now be described. Blade 30 is secured in the grooves by a coil spring 46 which seats tightly into circumferential groove 20. Tab 42 abuts spring 46 so that the blade is not urged out of the groove. Although the blade is shown secured in the grooves by a coil spring, it will be appreciated that any other form of securing means, such as metal band, can be used.

Figure 7:
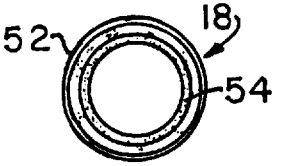
FIG. 7 is an end plan of one end of the sliding, collar of the connector taken along line 7—7 of FIG. 3.
Figure 8:
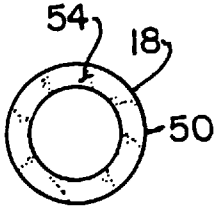
FIG. 8 is an end plan of the opposite end of the sliding collar of the connector along line 8—8 of FIG. 3.
Figure 9:
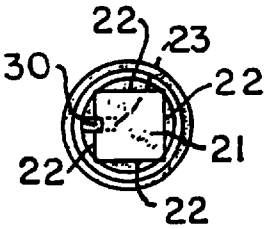
FIG. 9 is an end plan of the square end of another illustrative embodiment of the connector taken along line 9—9 of FIG. 3.

A coil bias spring 48 is positioned around barrel 19 and abuts slide section 17 of the body and retention collar 18 fits over spring 48. Retention collar 18 is shown in greater detail in FIGS. 7 and 8. Collar 18 has a tubular body 50 with a raised knurled gripping ring 52 at the midpoint. The first end of body 50 has an opening 52 which is dimensional to allow the collar to slide onto the connector. The opposite end has an inner ring 54 which defines opening 56. Opening 56 is dimension so that ring 54 will slide over barrel 19 but not over slide section 17. Further, the diameter of opening 56 is less than the diameter of spring 48. Thus, spring 48 is biased between ring 54 and slide section 17 and normally biases the collar forward. The collar 18 can be retracted on the slide section 17.

Figure 11:
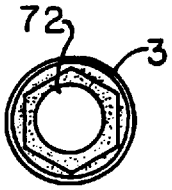
FIG. 11 is an end plan of the opposite end of the socket taken along line 11—11 of FIG. 10.
Figure 10:
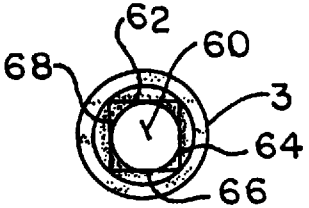
FIG. 10 is an end plan of a socket taken along line 10—10 of FIG. 4.

As shown in the drawings connector 1 is releasably attached to a conventional socket 3. Socket 3 has a quadrilateral bore 60 at one end defined by walls 62, 64, 66 and 68. Each of the last said walls has a depression 70 formed therein to engage the detent tip 38 of blade 30 when the socket it mounted on the connector. If the connector employs more than one blade, e.g. FIG. 4, a tip of each blade engages a depression in opposite walls to further secure the socket on the connector. The opposite end of socket 3 (FIG. 11) has a conventional six-sided opening 72 designed to engage a workpiece, such as a nut or bolt or the like.

The connector 1 of the present invention functions as follows: bias spring 48 normally biases collar 18 toward square end 21. Consequently, because the blades 30 are connected to ring 54 of the collar, the blades also are biased toward the square end. Since groove 23 is shallow at the square, detent tips 30 normally protrude from the groove so that the tip engages a depression 70 within the socket bore wall to secure the socket on the square end. To disengage the socket (or to attach a socket) the user draws collar 18 back against the bias spring, 48. As the collar slides back on slide section 17 of the body the blades 30 are drawn away from the square end. Since groove 23 is deeper away from the tip, the blade recedes into the groove so that the detent tip 38 is flush with the barrel. Thus, the detent tip 38 is withdrawn from the depression 70 to allow the socket to be removed from connector 1.

It will be appreciated that a single blade 30 will prevent a socket from dislodging from the connector. However, it also will be appreciated that more than one retractable blades, e.g. up to four will hold the socket on the connector more securely. Thus, in situations where a lot of pressure or torque is applied to the socket through the connector a connector with more than one retractable blades may be used. The novel design of the locking mechanism allows for more than one such blade to be employed on a single connector.

Further, it will be appreciated that, although the mechanism as described herein is primarily employed with a foul-sided square end or drive, the same principles can be applied to a cylindrical drive. The shallow blade and groove combination can be constructed in a cylindrical drive means.

Variations or modifications to the subject matter of this invention as described may occur to those skilled in the art upon reviewing the description of the invention as set forth. Such variations or modifications, if within the spirit of this invention, are intended to be encompassed within the scope of any claims to patent protection issuing upon this development. The description of the preferred embodiment set forth in this application is provided for illustrative purposes only.

I claim:

1. A releasably locking connector comprising:

an elongated body having a square end at one end for introduction into a complementary opening in a socket, said body and square end having at least one elongated groove formed therein, said groove decreases in depth from said body to said square end;

a detent blade slidably seated in said groove;

a spring biased collar on said body and operably attached to said detent blade, said collar being normally biased in a first position wherein the attached detent blade is in a first position protruding from said groove so as to engage and lock in said opening in the socket, said collar being slidable to a second position wherein the attached detent blade recedes within the groove to release the detent blade from the opening in the socket.

2. The connector of claim 1 wherein said detent blade has a detent tip protruding from one end for engaging a complementary depression formed in said opening in the socket.

3. The connector of claim 1 wherein said detent blade has a hook and tab at an opposite end for engaging a ring on said sliding collar.

4. A connector for releasably engaging a socket, comprising:

an elongated cylindrical body having a first end with an opening formed therein, a concentric collar seat adjacent the first end and a second concentric section having a square end adjacent the collar seat, said second concentric section and square end having at least one elongated groove formed therein;

a spring biased cylindrical sliding collar on said collar seat;

a detent blade slidably seated within said groove, said collar having a detent tip at one end and a hook and tab means for engaging said sliding collar on an opposite end;

said sliding collar being normally biased in a forward position wherein said detent blade is urged forward in said groove whereby said detent tip protrudes from said groove, said sliding collar being slidable to a rearward position wherein said detent blade is drawn back and recedes into said groove so that said detent tip is withdrawn into said groove.

5. A releasably locking connector comprising:

an elongated body having a square end at one end for introduction into a complementary opening in a socket, said body and square end having at least two grooves formed therein;

a detent blade slidably seated in each of said grooves;

a spring bias collar on said body and operably attached to said detent blade, said collar being normally biased in a first position wherein the attached detent blade is in a first position protruding from said groove so as to engage and lock in said opening in the socket, said collar being slidable to a second position wherein the attached detent blade recedes within the groove to release the detent blade from the opening in the socket.

* * * * *